US005524554A

United States Patent [19]

Wilson et al.

[11] Patent Number: 5,524,554

[45] Date of Patent: Jun. 11, 1996

[54] PALLET FOR STACKING CATERING EQUIPMENT

[75] Inventors: Michael C. Wilson; David M. Shannon, both of Oklahoma City, Okla.

[73] Assignee: Continental Carlisle, Inc., Oklahoma City, Okla.

[21] Appl. No.: 397,844

[22] Filed: Mar. 2, 1995

[51] Int. Cl.[6] ..... B65D 19/38

[52] U.S. Cl. ..... 108/53.1; 108/901; 206/599

[58] Field of Search ..... 108/51.1, 53.1, 108/902, 901; 206/386, 599

[56] References Cited

U.S. PATENT DOCUMENTS

| | | | |
|---|---|---|---|
| 3,348,738 | 10/1967 | Hertlein . | |
| 3,524,415 | 8/1970 | Heiman . | |
| 3,563,184 | 2/1971 | Anglebeck, Jr. . | |
| 3,636,888 | 1/1972 | Angelbeck | 108/53.1 |
| 3,776,435 | 12/1973 | Smith . | |
| 3,921,540 | 11/1975 | Melnick et al. . | |
| 4,000,704 | 1/1977 | Griffin | 108/53.1 |
| 4,746,034 | 5/1988 | Ata et al. . | |
| 5,092,251 | 3/1992 | Hamaker et al. . | |

FOREIGN PATENT DOCUMENTS

| | | | |
|---|---|---|---|
| 4-114859 | 4/1992 | Japan | 108/53.1 |

OTHER PUBLICATIONS

Continental/SiLite International Product Brochure front cover and pp. 28, 29, 30, 31 and 32 which show prior art buffet and catering equipment.

*Primary Examiner*—James R. Brittain

*Assistant Examiner*—Gerald A. Anderson

*Attorney, Agent, or Firm*—Dougherty, Hessin, Beavers & Gilbert

[57] ABSTRACT

A pallet used for stacking various types of catering and food service equipment is disclosed. The pallet has a floor which includes an upper surface and a lower surface. A forward wall and end wall and a pair of side walls extend upwardly from the top surface. A pair of rear legs, a pair of intermediate legs, and a pair of forward legs extend downward from the lower surface of the floor. The forward and intermediate legs define openings which will receive and interlock with the handles of the catering equipment. Likewise, the rear and intermediate legs define a pair of rear openings which will receive the upwardly extending handles of the catering equipment thereby interlocking the pallet and the catering equipment. The pallet also includes a downwardly extending rear support beam which has a transverse slot disposed therein. The transverse slot is a means for receiving handles of certain types of catering equipment so that the catering equipment and pallet will interlock. The upper surface of the pallet has a number of recesses and steps configured to interengage the lower end or legs of various types of catering equipment.

23 Claims, 7 Drawing Sheets

PALLET FOR STACKING CATERING EQUIPMENT

BACKGROUND OF THE INVENTION

This invention relates to a pallet for stacking catering equipment, and more particularly, to a pallet which has a lower surface and an upper surface which will interlock with the handles and bases of catering equipment respectively, so that such catering equipment can be stacked and transported in a stable and secure manner.

In the catering and food service industry, several types of equipment are used to transport food and beverages to and from a kitchen or other serving site. For example, beverages and other liquids, such as soups and chilis, are carried in beverage or liquid dispensers that vary in size and include one gallon, two and a half gallon, five gallon and ten gallon capacities. Standard prior art liquid dispensers of different sizes are shown in FIGS. 1 and 2 respectively. The dispenser shown in FIGS. 1 and 2 are representative of five (5) and ten (10) gallon dispensers respectively. Typical five (5) and ten (10) gallon dispensers include the LD500™ and LD1000™ respectively, both manufactured by Continental/SiLite International.

Food which is to be transported is generally placed in a food pan prior to being placed in the catering equipment in which it will be transported. Food is transported in various types of equipment, depending on the size and shape of the pan in which the food is placed. One prior art type of food carrier, which is generally designated as a side loader, is shown in FIG. 3. The side loader is designated as such because the equipment is hinged to allow the side to open. Although side loaders may have different shapes and sizes, the typical side loader is shaped similarly to the prior art side loader shown in FIG. 3, and will accommodate full size food pans along with other size food pans, such as one-third and one-half size food pans. A typical prior art side loader is the PC200™, manufactured by Continental/SiLite International. As seen in FIG. 3, the side loader includes a top surface which has a pair of handles extending upwardly therefrom.

Another prior art type of catering equipment, or container, designated as an end loader is shown in FIG. 4. The end loader includes hinges which allow the end of the equipment to open and close. The end loader will accommodate all full size food pans of varying depths, including but not limited to, 6 inch, 4 inch and 2½ inch pans. One prior art end loader is the PC300™, manufactured by Continental/SiLite International. The end loader, like the side loader, includes a pair of upwardly extending handles.

Prior art equipment top loaders are shown in FIGS. 5 and 6. Top loaders are manufactured in various sizes including, but not limited to, a 4 inch single pan carrier, a 6 inch single pan carrier, and a combination pan carrier. Prior art top loaders of the type listed above include the PC140™, the PC160™ and the PC180™ respectively all manufactured by Continental/SiLite International. The top loader shown in FIG. 6 has a shape representative of smaller capacity loaders, such as the PC140™ and the PC160™, while the loader shown in FIG. 5 is representative of a large capacity top loader, such as a PC180™. A large capacity top loader, like that shown in FIG. 5, includes a pair of upwardly extending handles.

Prior art catering equipment, like that described herein, is in certain cases stackable. For instance, the lower end of the side loader, end loader and large capacity top loader is designed to receive the upwardly extending handles of other side, end and top loaders, so that the equipment may be stacked. Likewise, the prior art liquid dispensers shown in FIGS. 1 and 2 may be stacked upon one another. However, it is often desirable to be able to stack and transport various combinations of catering equipment which presently cannot be stacked. Providing for such stacking would decrease the number of trips required to and from a food site, thus decreasing the time required to set up an event to be catered. It is also desirable to provide a method to stack such catering equipment so that the catering equipment is stable and secure for transport on dollies. The pallet of the present invention meets those needs by providing for the stable, secure stacking and interlocking of various combinations of catering and food service equipment.

SUMMARY OF THE INVENTION

The pallet of the present invention comprises a pallet floor, or base, having an upper or top surface, a bottom or lower surface, a forward end and a rear end. The bottom surface is configured to receive and interlock with the handles of various types of catering equipment. The top surface is adapted to receive and interlock with the lower end or legs of various types of catering equipment. The pallet includes a forward end wall and a rear end wall. The forward end wall extends upwardly from the top surface at the forward end of the pallet. The rear end wall extends upwardly from the top surface at the rear end of the pallet.

The pallet may also include a pair of transversely opposed side walls extending upwardly from the top surface. The transverse direction, as referred to herein, is the side to side or the lateral direction. The forward to rear, or end to end direction may be referred to as the long or longitudinal direction. The side walls may be comprised of a first or left side wall and a second or right side wall. The forward end wall, rear end wall and side walls captively retain catering equipment stacked on the top surface of the pallet.

The upper surface of the pallet floor may further include a recessed portion, an intermediate portion, and a stepped portion. The recessed portion includes a plurality of recesses defined in the upper surface. The recessed portion may include four recesses, one each of said recesses being positioned at or near a corner of the upper surface of the floor. The recesses may comprise substantially L-shaped recesses and are positioned to receive the legs or lower end of pieces of catering equipment. For instance, the legs of a side loader, end loader and top loader, or any similarly configured catering equipment, will engage the four recesses defined in the upper surface of the pallet.

The stepped portion includes a plurality of steps having coplanar upper surfaces. The stepped portion may include a center step, a forward step defined between the center step and the forward end wall, and a rear step defined between the center step and the rear end wall. The forward and rear steps may be substantially the same size and configuration. The stepped portion will receive various types of catering equipment having a flat or substantially flat lower surface.

The intermediate portion or intermediate surface of the upper surface is the surface which lies between the recessed portion and the stepped portion. The intermediate portion will receive the lower end or legs of various types of catering equipment. When catering equipment is received on the intermediate surface, the stepped portion will act as a stabilizer and will prevent slippage of the equipment.

The pallet also includes a pair of stabilizing shoulders extending upwardly from the pallet floor. The shoulders may include a forward shoulder and a rear shoulder. The forward and rear shoulders will engage certain types of catering equipment stacked on the upper surface to prevent slippage and to secure the equipment thereon.

A pair of transversely opposed slots may be disposed through the pallet floor. The slots allow for the use of cargo or tie down straps and may be positioned at the longitudinal center of the floor. The upper surface of the pallet floor may be symmetric about both a lateral, or transverse, and a longitudinal central axis.

The pallet may also include a pair of transversely opposed downwardly extending rear legs disposed at the rear end of the floor, a pair of transversely opposed downwardly extending forward legs disposed at the forward end of the floor and a pair of transversely opposed downwardly extending intermediate legs disposed between the forward legs and rear legs. The pallet may further include a receiving means disposed between the rear legs for captively receiving an upwardly extending handle of a piece of catering equipment positioned thereunder, thereby preventing relative movement between the catering equipment and the pallet.

The pallet may further comprise a downwardly extending transverse rear support beam located at the rear end of said floor. The support beam extends downwardly from the bottom surface of the floor and the rear legs extend downwardly therefrom. The receiving means may comprise a transverse slot disposed in the rear support beam between the rear legs. The transverse slot will captively receive an upwardly extending handle of a piece of catering equipment thereby interlocking the pallet and the catering equipment and substantially preventing relative movement therebetween.

The pallet may further comprise a downwardly extending forward support beam located at the forward end of the pallet with the forward legs extending downwardly therefrom, and an intermediate support beam disposed between the rear and forward support beams. The intermediate support beam extends downwardly from the bottom surface of the pallet floor, and interconnects the pair of intermediate legs. The invention also includes a first, or left rib connected at a first end to the forward support beam and at a second end to the intermediate support beam and a second, or right rib connected at a first end to the forward support beam and at a second end to the intermediate support beam. The first rib, second rib and forward and intermediate support beams define a cavity for receiving the upwardly extending handle of a piece of catering equipment when the catering equipment is placed beneath the pallet. When the handle is received in the cavity, the cavity will prevent relative lateral movement between the catering equipment and the pallet.

The pair of forward legs and the pair of intermediate legs may define a pair of forward openings for receiving the upwardly extending handles of a piece of catering equipment, so that the pair of forward openings substantially prevent relative movement between the catering equipment and the pallet when the handles are received therein. The invention may further include a pair of rear openings defined between the intermediate legs and the rear legs. The pair of rear openings will receive the upwardly extending handles of catering equipment and will prevent relative movement between the catering equipment and the pallet when the handles are received therein. Specifically, the pair of rear openings is designed to receive the handles of two prior art beverage dispensers of the type shown in FIG. 1, or any other similarly configured catering equipment, when the dispensers are placed side by side beneath the pallet.

The pair of forward openings may be defined by a pair of rear facing forward notches or grooves defined in the pair of forward legs and a pair of forward facing intermediate notches or grooves defined in the pair of intermediate legs, such that the handles of the catering equipment are received in the notches. The rear openings may be defined by a pair of forward facing rear notches or grooves defined in the rear legs and a rear facing surface defined on the pair of intermediate legs so that the handles of the catering equipment are received between the forward facing rear notches and the rear facing surface of the intermediate legs.

BRIEF DESCRIPTION OF THE DRAWINGS

FIGS. 5 and 6 illustrate additional pieces of prior art catering equipment typically identified as top loaders.

FIG. 6A is a bottom view of the prior art catering equipment shown in FIG. 6.

DETAILED DESCRIPTION OF THE INVENTION

Figure 7:
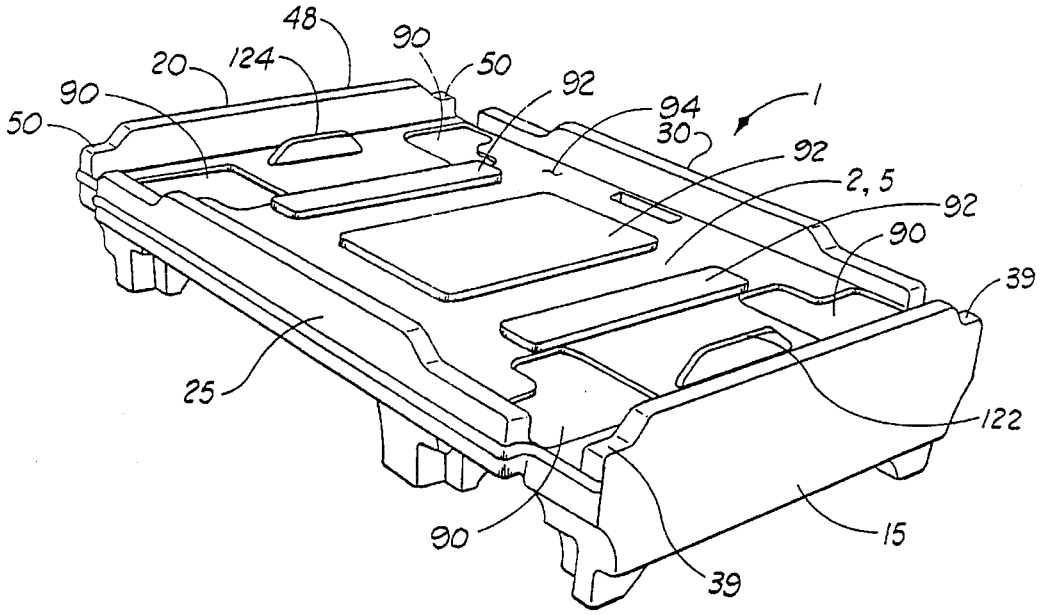
FIG. 7 is a perspective view showing the top, left side and forward end of the pallet.
Figure 8:
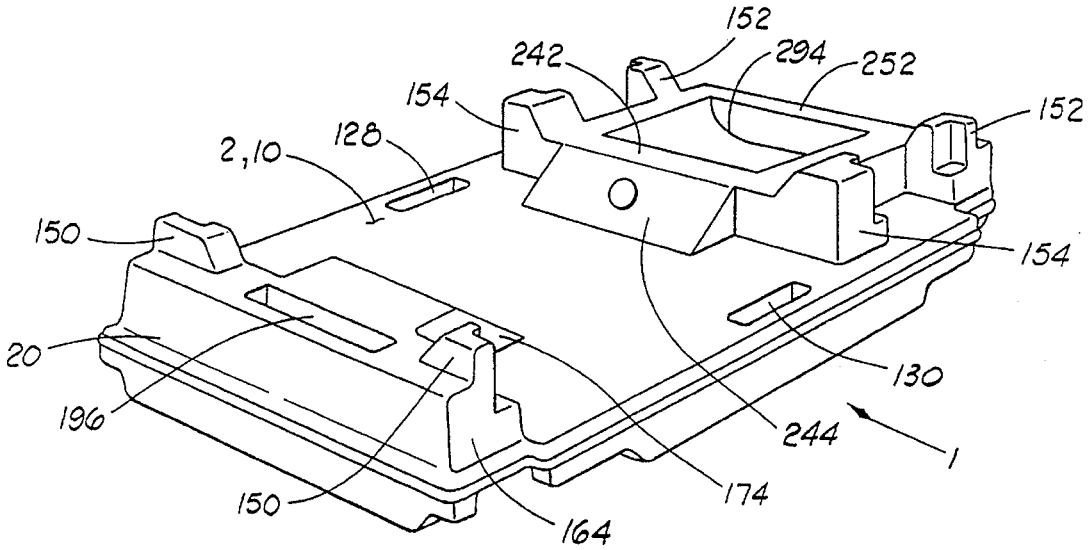
FIG. 8 is a perspective view showing the bottom right, side and rear end of the pallet of the present invention.
Figure 9:
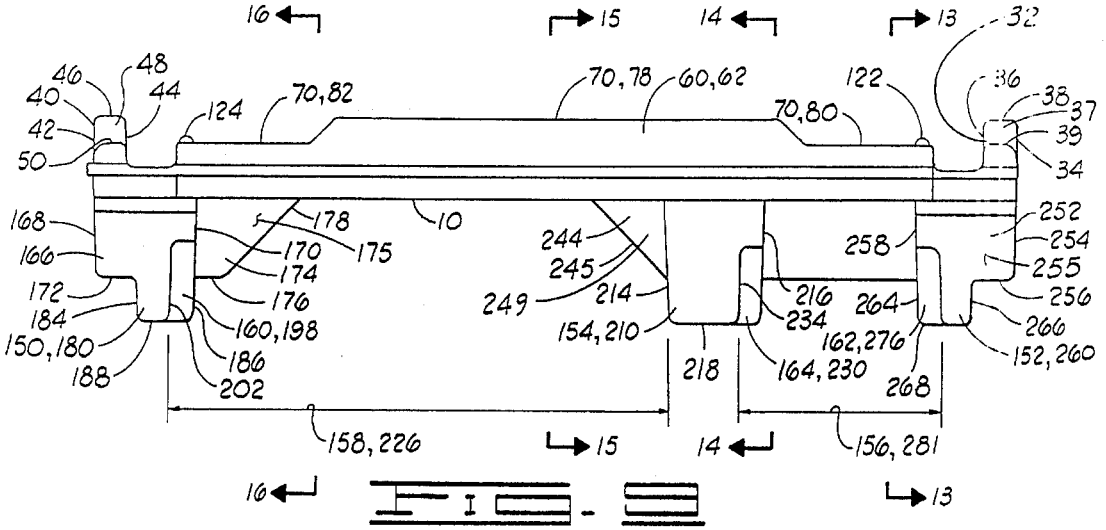
FIG. 9 is a view of the left side of the present invention.
Figure 10:
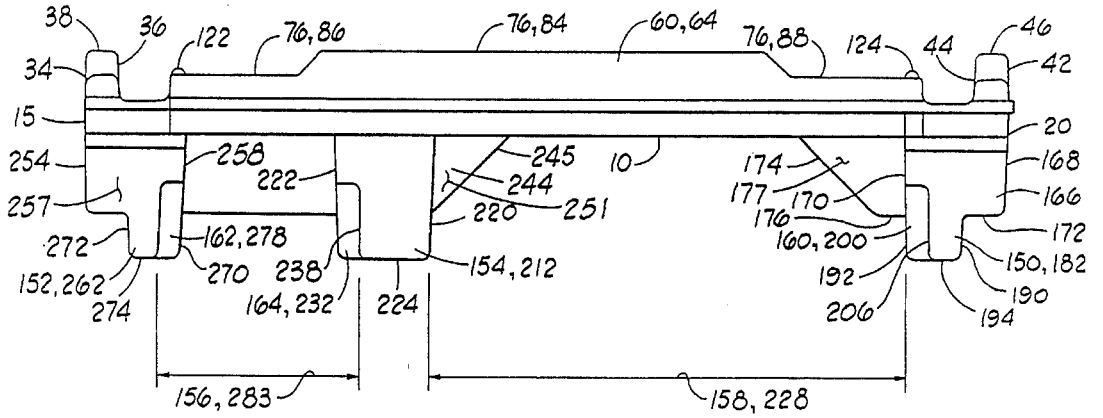
FIG. 10 is a view of the right side of the present invention.
Figure 17:
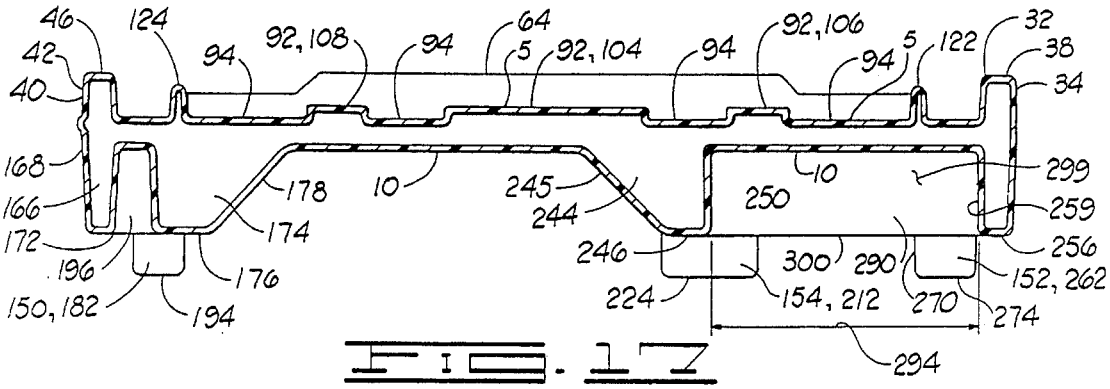
FIG. 17 is a section view taken through line 17—17 shown on FIG. 11.
Figure 11:
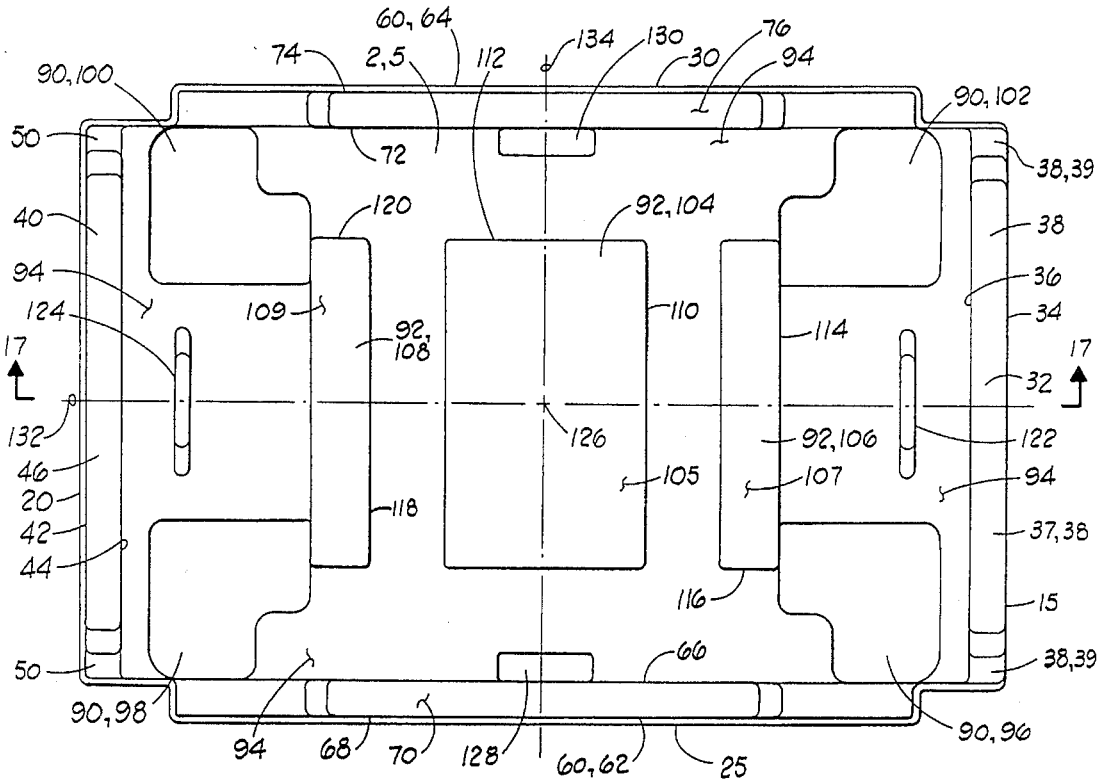
FIG. 11 is a perspective view of the top of the pallet of the present invention.
Figure 12:
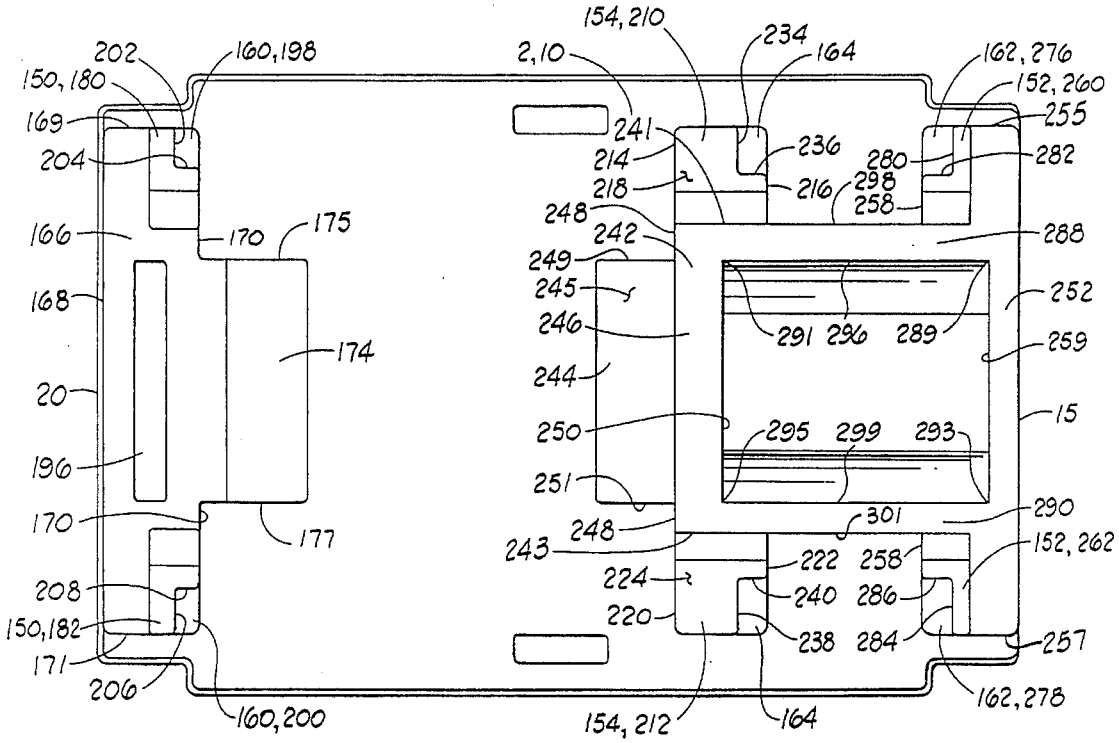
FIG. 12 is a perspective view of the bottom of the pallet of the present invention.
Figure 13:
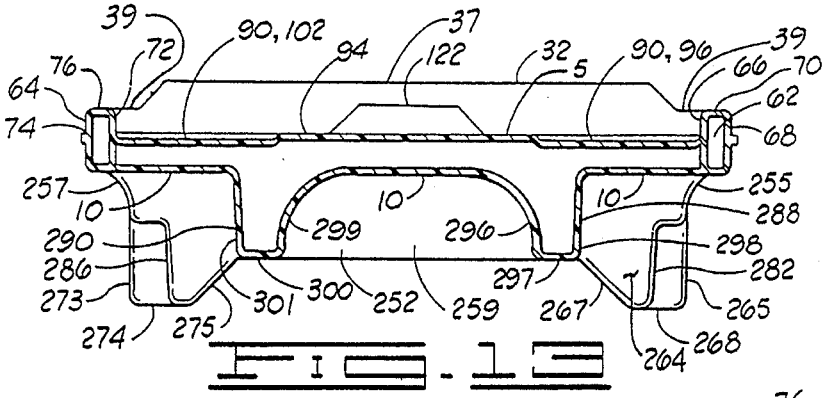
FIG. 13 is a section view taken through line 13—13 shown on FIG. 9.

Referring now to the drawings and more particularly to FIG. 7, the pallet of the present invention, which may be referred as an apparatus for stacking catering equipment, is shown and generally designated by the numeral 1. The pallet is preferably formed as a single unitary piece. The pallet is more preferably formed as a single unitary piece from a polyethylene material, such as plastic. The pallet includes a pallet floor 2 which has a top or upper surface 5 and a bottom or lower surface 10. As shown in the various figures, bottom surface 10 is spaced downwardly from top surface 5. The pallet also includes a forward end 15 and a rear end 20, a first or left side 25 and a second or right side 30.

The invention further includes a transverse forward wall 32 extending upwardly from top surface 5 of forward end 15 of the pallet. The transverse direction as referred to herein is the lateral or side to side direction. The rear to forward, or end to end direction may be referred to as the long or longitudinal direction. Forward wall 32 includes a forward facing surface 34, a rearward facing surface 36 and an upper edge 38. Forward wall 32 may comprise a stepped wall having a center, or high portion 37, and outer, or low portions 39. A transverse rear end wall 40 extends upwardly from top surface 5 at the rear end 20 of the pallet. Rear end wall 40 has a rear facing surface 42, a forward facing surface 44 and an upper edge 46. Rear end wall 40 may comprise a stepped wall having a high or center portion 48 and low, or outer portions 50.

A pair of side walls 60 extend upwardly from the sides of the pallet floor. The pair of side walls 60 may include a first or left hand side wall 62 extending upwardly from top surface 5 at left side 25 of the pallet and a second or right side wall 64 extending upwardly from top surface 5 at right side 30. Left side wall 62 has an inner surface 66, an outer surface 68 and an upper edge 70. Right side wall 64 has an inner surface 72, an outer surface 74 and an upper edge 76. Left side wall 62 also includes a center portion 78 and end portions 80 and 82 wherein center portion 78 is taller than end portions 80 and 82. Likewise, right side wall 64 may be comprised of a center portion 84 and two end portions 86 and 88 wherein the center portion 84 is taller than end portions 86 and 88.

Figure 14:
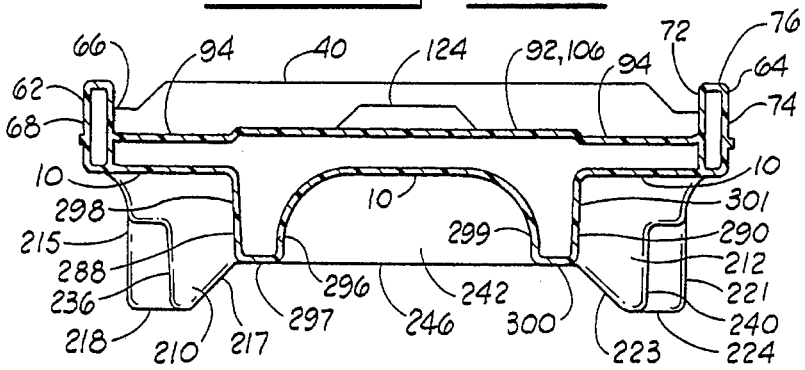
FIG. 14 is a section view taken through line 14—14 shown on FIG. 9.
Figure 15:
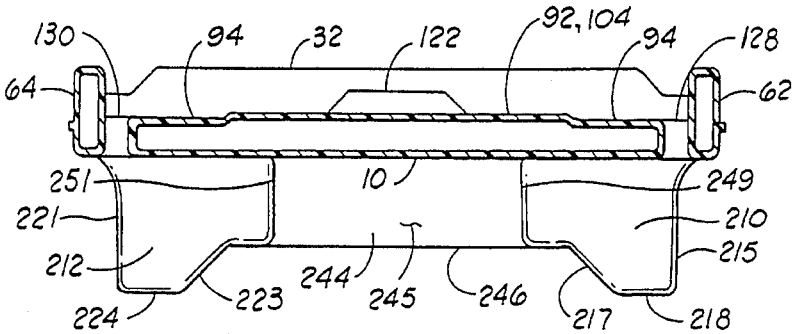
FIG. 15 is a section view taken through line 15—15 shown on FIG. 9
Figure 16:
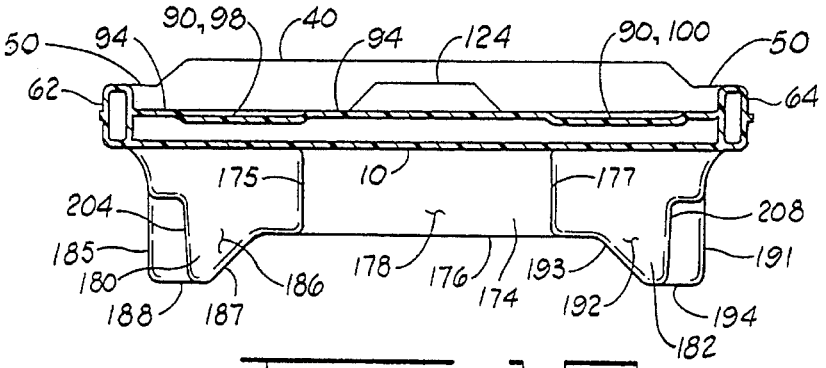
FIG. 16 is a section view taken through line 16—16 shown on FIG. 9.

Upper surface 5 includes a recessed portion 90, a stepped portion 92 and an intermediate portion 94. Recessed portion 90 includes first, second, third and fourth recessed surfaces 96, 98, 100 and 102 respectively. Recessed surfaces 96, 98, 100 and 102 are positioned at or near a corner of upper surface 5 as better seen in FIG. 14. More specifically recessed surfaces 96, 98, 100 and 102 are positioned respectively at the forward left, rear left, rear right and forward right corners of the pallet. Recessed surfaces 96, 98, 100 and 102 may be substantially identically shaped and may comprise substantially L-shaped recesses. The recesses are coplanar and are, as explained more fully herein, positioned to receive the lower end or legs of various types of catering equipment, such as, but not limited to, end loaders, side loaders and top loaders of a type like or similar to those shown in FIGS. 3, 4 and 5.

Stepped portion 92 includes a center step 104, a forward step 106 and a rear step 108. Forward step 106 is defined on upper surface 5 between center step 104 and forward end wall 32. Rear step 108 is defined on upper surface 5 between center step 104 and rear end wall 40. Center step 104 may be a rectangular step having a long side 110 and a short side 112. Likewise, forward step 106 is a rectangular step having a long side 114 and a short side 116 and rear step 108 is a rectangular step having a long side 118 and a short side 120. Long sides 110, 114 and 118 may be of equal length. Steps 104, 106 and 108 include substantially coplanar surfaces 105, 107 and 109 respectively, which will engage the lower surface of any type of catering equipment having a flat or substantially flat lower surface, and will stabilize and prevent slippage of catering equipment which has a lower end or lower legs that engage the surface defined between stepped portion 92 and recessed portion 90, which is designated as intermediate portion or intermediate surface 94.

Intermediate surface 94, like steps 92 and recesses 90, will engage the lower end or lower legs of various types of catering equipment. Steps 104, 106 and 108 will prevent slippage of catering equipment which engages intermediate surface 94, such as, but not limited to, various sizes of liquid dispensers, like or similar to the dispensers shown in FIGS. 1 and 2.

A forward stabilizing shoulder 122 and a rear stabilizing shoulder 124 extend upwardly from the upper surface 5 of the pallet floor. Specifically, shoulders 122 and 124 extend upwardly from intermediate surface 94. Forward shoulder 122 is located between forward step 106 and forward end wall 32, while rear shoulder 124 is located between rear step 108 and rear end wall 40. Equipment having a substantially flat lower surface may be placed on stepped portion 92 between shoulders 122 and 124. Shoulders 122 and 124 may be substantially trapezoidal shaped and may be positioned at an equal distance from a transverse axis 134. The invention also includes a pair of transversely opposed cargo slots 128 and 130 disposed through the pallet floor. The slots may be used in conjunction with cargo straps or tie down straps to secure any equipment stacked on top of the pallet floor. The upper surface of the pallet floor, as described herein, is symmetric about both a longitudinal center axis 132 and transverse axis 134.

The invention also includes a pair of downwardly extending rear legs 150 disposed at rear end 20 of the floor, a pair of downwardly extending forward legs 152 disposed at forward end 15 and a pair of downwardly extending intermediate legs interposed between rear legs 150 and forward legs 152. Forward legs 152 and intermediate legs 154 define a pair of forward openings 156 for receiving the handles of a piece of catering equipment. For instance, forward openings 156 will receive a pair of upwardly extending handles 402 of the prior art beverage dispenser 400 shown in FIG. 1 or any similarly configured dispenser.

Likewise, intermediate legs 154 and rear legs 150 define a pair of rear openings 158 for receiving the handles of catering equipment. For instance, openings 158 will receive the handles 402 of two prior art beverage dispensers like or similar to those shown in FIG. 1 when such dispensers are placed side by side. The pair of forward and rear openings will substantially prevent relative movement between the catering equipment and the pallet when the upwardly extending handles of the catering equipment are received therein.

Rear legs 150 include a forward facing pair of grooves, or notches, 160 so that the air of rear openings 158 is defined by forward grooves 160 and intermediate legs 154. Forward legs 152 include a pair of rear facing notches, or grooves, 162 while intermediate legs 154 include a pair of forward facing notches, or grooves, 164 so that the pair of forward openings 156 are defined by grooves 162 and 164.

A rear support beam 166 extends downwardly at rear end 20 of the pallet. Rear support beam 166 has a rear surface 168, a forward surface 170, left and right hand surfaces 169 and 171 respectively and a lower surface 172. A rear inclined stiffener 174 is attached to and extends forward from forward surface 170 of rear support beam 166. Rear inclined stiffener 174 includes a lower surface 176, left and right hand surfaces 175 and 177 respectively and an inclined surface 178. Left and right hand surfaces 175 and 177 extend forward from forward surface 170 of rear support beam 166 until they merge with inclined surface 178. Lower surface 176 of the inclined stiffener is coplanar with lower surface 172 of rear support beam 166. Inclined surface 178 is attached to and merges with bottom surface 10 of the pallet floor and lower surface 176 of inclined stiffener 174.

The pair of rear legs 150 extend downwardly from lower surface 172 of rear support beam 166. Legs 150 include a first, or left rear leg 180 and a second, or right rear leg 182. First rear leg 180 includes a rear surface 184, a forward surface 186, an outer surface 185, an inclined inner surface 187 and a lower surface 188. Second rear leg 182 includes a rear surface 190, a forward surface 192, an outer surface 191, an inner inclined surface 193 and a lower surface 194. Forward surface 170 of rear support beam 166 is coplanar with forward surfaces 186 and 192. Rear surfaces 184 and 192 are displaced forward from rear surface 168.

A transverse slot 196 is disposed in rear support beam 166 between first and second rear legs 180 and 182 respectively. Transverse slot 196 will captively receive the upwardly extending handle of various types of catering equipment. For instance, slot 196 will receive the upwardly extending handles of pieces of catering equipment like or similar to those shown in FIGS. 2–5. Thus, transverse slot 196 may be referred to as a receiving means for captively receiving an upwardly receiving handle.

The pair of forward facing grooves 160 includes a first, or left rear groove 198 defined on forward surface 186 of first rear leg 180 and a second, or right rear groove 200 defined on forward surface 192 of second rear leg 182. The first and second rear grooves extend vertically upward from the bottom surfaces of the first and second rear legs. Grooves 198 and 200 are longer than legs 180 and 182 respectively, so that the grooves extend into and terminate on forward surface 170 of rear support beam 160. First rear groove 198 includes a forward facing surface 202 and an outwardly facing surface 204. Likewise, groove 200 includes a forward facing surface 206 and an outwardly facing surface 208. Forward facing surfaces 202 and 206 are substantially coplanar.

The pair of intermediate legs 154 includes a first or left intermediate leg 210 and a second or right intermediate leg 212. First intermediate leg 210 includes a rear surface 214, a forward surface 216, an outer surface 215, an inner inclined surface 217 and a lower surface 218. Second intermediate leg 212 has a rear surface 220, a forward surface 222, an outer surface 221, an inner inclined surface 223 and a lower surface 224. Rear surfaces 214 and 220 are substantially coplanar.

The pair of rear openings 158 therefore comprise a first, or left rear opening 226 and a second or right rear opening 228. First rear opening 226 is defined by rear surface 214 of first intermediate leg 210 and forward facing surface 202 of first rear groove 198. Second rear opening 228 is defined by rear surface 220 of second intermediate leg 212 and forward facing surface 206 of second rear groove 200.

The pair of forward facing grooves 164 defined in intermediate legs 210 and 212 include a first, or left intermediate groove 230 defined on forward surface 216 of first intermediate leg 210 and a second, or right, intermediate groove 232 defined on forward surface 222 of second intermediate leg 212. First intermediate groove 230 includes a forward facing surface 234 and an outward facing surface 236. Second intermediate groove includes a forward facing surface 238 and an outward facing surface 240.

An intermediate support beam 242 extends downwardly from bottom surface 10, and is connected at a first end 241 to first intermediate leg 210 and at a second end 243 to second intermediate leg 212. Intermediate support beam 242 has a lower surface 246, a rear surface 248 and a forward surface 250. Rear surface 248 merges with and is coplanar with rear surfaces 214 and 220 of first and second intermediate legs 210 and 212 respectively. An inclined stiffener 244 extends rearward from intermediate support beam 242. Inclined stiffener 244 includes an inclined surface 245 which extends rearward and upward from lower surface 246 of intermediate support beam 242 until it merges with bottom surface 10, and left and right webs 249 and 251 respectively. Left and right webs 249 and 251 extend in the rear direction from rear surface 248 of intermediate support beam 242 until they merge with, or connect to inclined surface 245.

A forward support beam 252 extends downward at the forward end 15 of the pallet. Forward support beam 252 includes a forward surface 254, a lower surface 256, left and right surfaces 255 and 257 respectively, a first rear surface 258 and a second rear surface 259. Forward surface 254 is coplanar with forward surface 34 of forward end wall 32. The pair of forward legs 152 extend downwardly from lower surface 256, and include a first, or left forward leg 260 and a second, or right forward leg 262. First forward leg 260 includes a rear surface 264, a forward surface 266, an outer surface 265, an inner inclined surface 267 and a lower surface 268. Second forward leg 262 includes a rear surface 270, a forward surface 272, an outer surface 271, an inner inclined surface 273 and a lower surface 274. Rear surfaces 264 and 270 of the first and second forward legs are coplanar and are coplanar with first rear surface 258 of forward support beam 252. Forward surfaces 266 and 272 are coplanar and are displaced rearward from forward surface 254 of forward support beam 252. Further, as described hereinabove, the rear legs are displaced forward from rear surface 168 of the rear support beam. The distance between the forward surfaces of the forward legs and the rear surfaces of the rear legs is less than the distance between rear surface 36 of forward end wall 32 and forward surface 44 of rear end wall 40. Thus, the legs of a first pallet may be received between the forward and rear end walls of a second pallet. Likewise, the outer surfaces of the downwardly extending legs may be received between sidewalls 62 and 64. Thus, the pallets are stackable upon one another.

The pair of forward grooves 162 includes a first, or left forward groove 276 defined in first forward leg 264 and a second, or right forward groove 278 defined in second forward leg 262. The first and second forward grooves extend vertically upward from the bottom surfaces of the first and second forward legs. Grooves 276 and 278 are longer than legs 260 and 262 respectively, so that the grooves extend into and terminate on first rear facing 258 of forward support beam 252. First forward groove 276 includes a rear facing surface 280 and a outward facing surface 282. Second forward groove 278 includes a rear facing surface 284 and an outward facing surface 286. The pair of forward openings 156 therefore include a first or left forward opening 281 defined by first forward groove 276 and first intermediate groove 230, and a second, or right forward opening 283 defined by second forward groove 278 and second intermediate groove 232. More specifically, first forward opening 281 is defined by rear facing surface 280 of first forward groove 276 and forward facing surface 234 of first intermediate groove 230. Second forward opening 283 is defined by rear facing surface 284 of second forward groove 278 and forward facing surface 238 of second intermediate groove 232.

Figure 1:
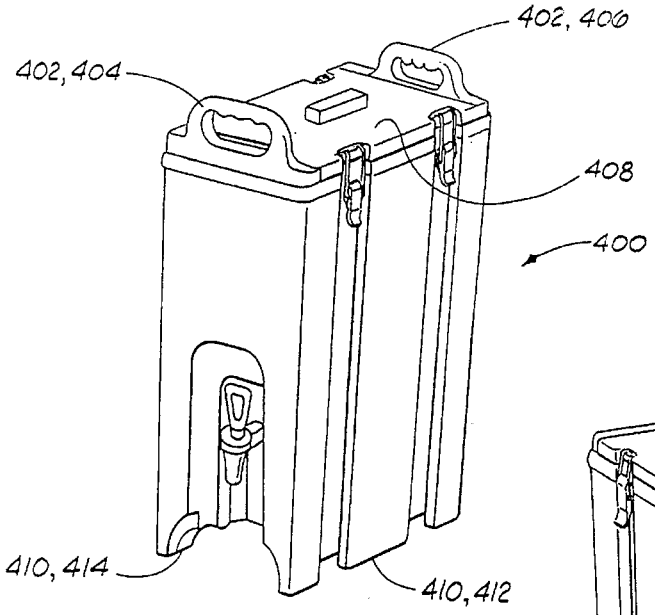
FIG. 1 shows a prior art beverage dispenser.

When the upwardly extending handles of the prior art catering equipment shown in FIG. 1 are received in the forward and rear openings, outward facing surfaces 204, 208, 236, 240, 282 and 286 will substantially prevent lateral movement between the pallet 1 and the catering equipment while the rear and forward facing surfaces will substantially prevent longitudinal relative movement.

The invention further includes a first, or left rib 288 and a second or right rib 290. The first and second ribs interconnect the forward support beam and the intermediate support beam. Rib 288 is connected at a forward end 289 to second rear surface 259 of forward support rear beam 252, and is connected at a rear end 291 to forward surface 250 of intermediate support beam 242. Rib 290 is connected at a forward end 293 to second rear surface 259 of forward support beam 252 and at a rear end 295 to forward surface 250 of intermediate support beam 242. Rib 288 has a curved inner surface 296, a lower surface 297 and an outer surface 298. Rib 290 has a curved inner surface 299, a lower surface 300, and an outer surface 301. Curved inner surfaces 296 and 298 extend from lower surfaces 297 and 300 of ribs 288 and 290 to lower surface 10 of the pallet floor.

The forward support beam, intermediate support beam and first and second ribs define a cavity 294 for receiving the upwardly extending handle of prior art catering equipment. More specifically, cavity 294 is defined by inner surfaces 296 and 299 of first and second ribs 288 and 290 respectively, and by second rear surface 259 of the forward support beam and forward surface 250 of the intermediate support beam. Thus, when the upwardly extending handle of a piece of prior art catering equipment like those or similar to those shown in FIGS. 2–5 is received in transverse slot 196, the upwardly extending handle at the opposite end of the catering equipment will generally be received in cavity 294. Transverse slot 196 and cavity 294 will substantially prevent relative movement between the catering equipment and the pallet when the handles of such catering equipment are received therein. Thus, any type of catering equipment having handles arranged similar to the equipment shown in FIGS. 2–5 may be placed below pallet 1 so that the handles of the equipment are received in slot 196 and cavity 294, thereby interlocking the pallet and the catering equipment.

Lower surfaces 188, 194, 218, 224, 268 and 274 of legs 180, 182, 210, 212, 260 and 262 respectively are substantially coplanar, so that the legs of the pallet will contemporaneously engage the upper surface of a piece, or pieces, of catering equipment placed therebelow. The depth of slot 196 and cavity 294 is such that when the upwardly extending handles are received therein, the lower surfaces of the legs will engage an upper surface of the catering equipment before the handles engage the bottom surface of the pallet. Likewise, when the upwardly extending handles of catering equipment are received in the forward and rear openings, the lower surfaces of the legs will engage the catering equipment before the handles reach the upper termination point of the grooves. Thus, the handles of the catering equipment will not be load bearing. In other words, the weight of the equipment stacked on top of the pallet will be carried completely by the legs, and not by the handles of the catering equipment positioned below the pallet.

Mode of Operation

FIGS. 1–6 show various types of catering equipment which can be stacked utilizing the present invention. FIG. 1 shows a prior art beverage dispenser. The beverage dispenser pictured in FIG. 1 has the configuration of a five (5) gallon dispenser, and may generally be designated by the numeral 400. Beverage dispenser 400 has a pair of upwardly extending handles 402, which may include a forward handle 404 and a rear handle 406. The beverage dispenser may also include an upper surface 408 and a lower end 410. The lower end 410 may include side legs 412 and 414.

Figure 2:
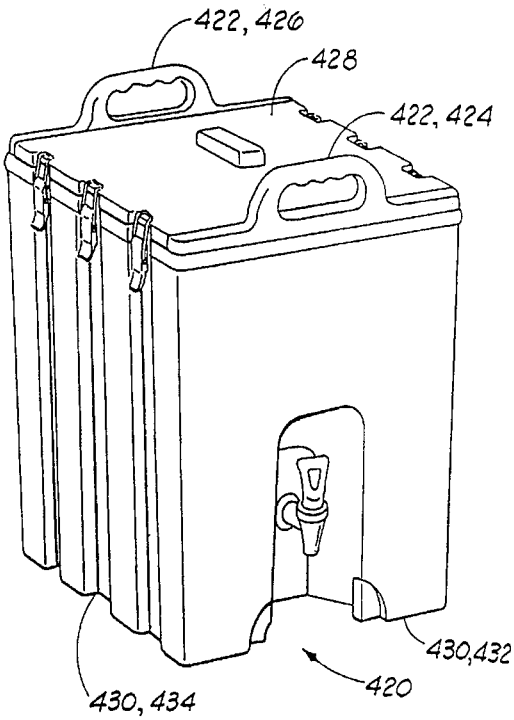
FIG. 2 shows an additional prior art beverage dispenser

FIG. 2 shows an additional embodiment of a beverage dispenser which may generally be designated by the numeral 420. Beverage dispenser 420 has a greater capacity than that of dispenser 400, and has the configuration of a ten (10) gallon beverage dispenser. Beverage dispenser 420 has a pair of upwardly extending handles 422 which comprise a forward handle 424 and a rear handle 426. Beverage dispenser 420 further includes an upper surface 428 and a lower end 430. Lower end 430 may comprise side legs 432 and 434.

Figure 3:
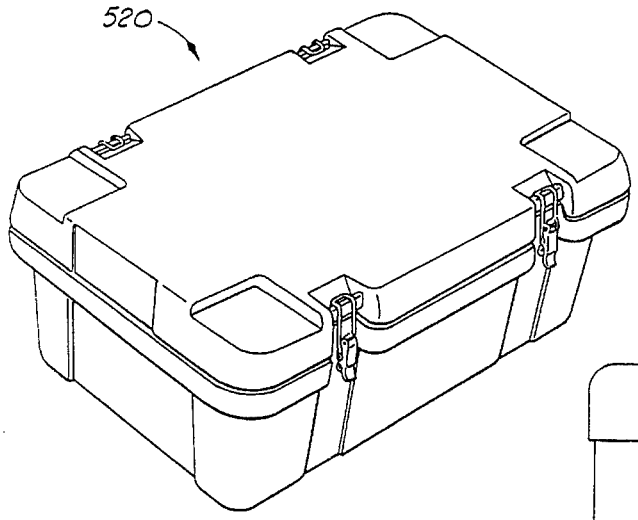
FIG. 3 shows a prior art piece of catering equipment typically identified as a side loader.
Figure 3A:
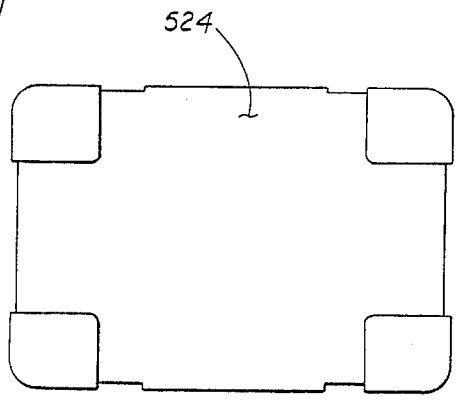
Figure 3:
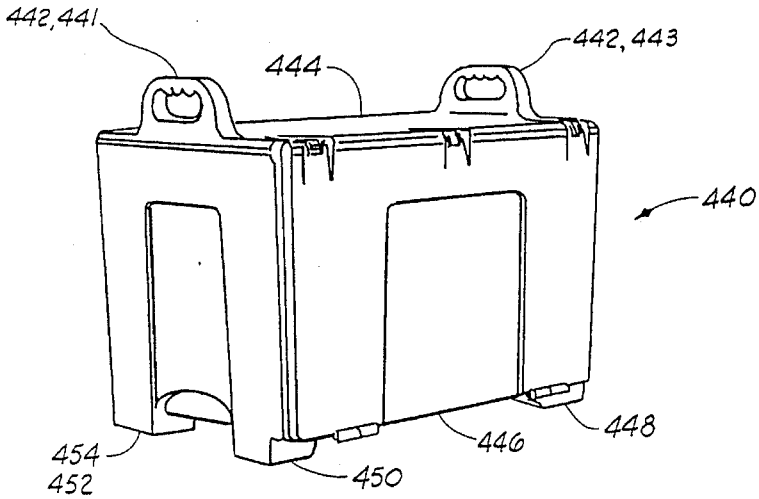

FIG. 3 shows a piece of catering equipment typically identified as a side loader, and generally designated by the numeral 440. Side loader 440 includes a pair of upwardly extending handles 442 which may comprise a left handle 441 and a right handle 443, an upper surface 444 and a lower end 446. Lower end 446 may include four corner legs having coplanar lower surfaces. Thus, side loader 440 may include legs 448, 450, 452 and 454 (not shown) wherein each leg is positioned at or near a corner of the lower end. Leg 454 is not shown, but as is plain is located at the corner opposed from legs 448 and 452. The side loader is designated as such because the equipment is hinged to allow the side to open and close. The typical side loader is shaped the same or substantially similar to the prior art side loader shown in FIG. 3 and will accommodate full size food pans along with other size food pans such as one-third and one-half size food pans.

Figure 4:
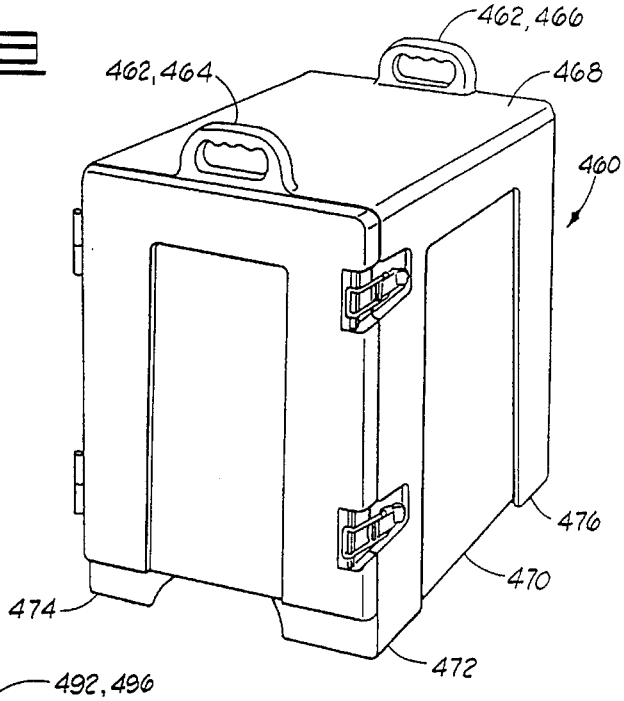
FIG. 4 shows an additional piece of prior art catering equipment, typically identified as an end loader.

FIG. 4 shows a piece of catering equipment typically identified as a end loader, and generally designated by the numeral 460. End loader 460 has a pair of upwardly extending handles 462 which may include a forward handle 464 and a rear handle 466. End loader 460 also includes an upper surface 468 and a lower end 470. Lower end 470 may include four corner legs having coplanar lower surfaces. Thus, end loader 460 may include downwardly extending legs 472, 474, 476 and 478 (not shown), each leg being positioned at or substantially at a corner of the lower end of the end loader. Leg 478, while not shown, is positioned at the corner opposed from leg 474 and leg 476. The end loader hinges to allow the end of the equipment to open and close. The end loader will accommodate full size food pans of varying depths.

Figure 5:
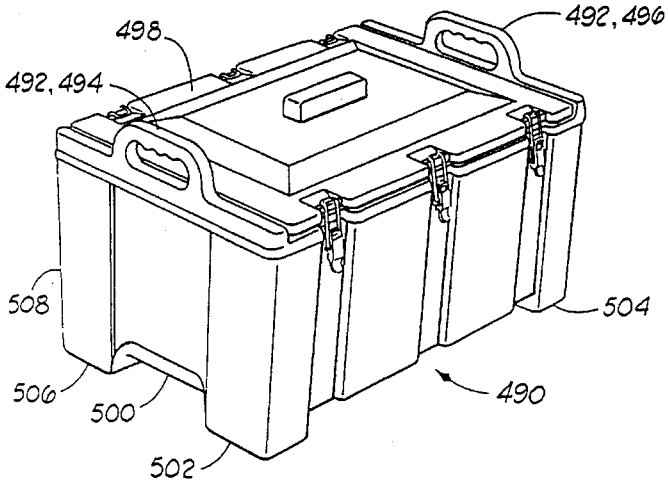

FIG. 5 shows a piece of catering equipment typically identified as a top loader and generally designated by the numeral 490. Top loader 490 includes a pair of upwardly extending handles 492 which may comprise a left handle 494 and a right handle 496. Top loader 490 also includes an upper surface 498 and a lower end 500. Lower end 500 may include four corner legs having coplanar lower surfaces. Thus, top loader 490 may include legs 502, 504, 506 and 508 (not shown), each leg being positioned at or near a corner of said lower end. Leg 508, while not shown, is positioned at the corner opposed from legs 506 and 504. Top loader 490 is designated as such because the top of the equipment opens. Top loader 490 will accommodate various sizes of food pans.

FIG. 6 shows a piece of catering equipment typically identified as a top loader, which is generally designated by the numeral 520. Top loader 520 has the configuration of a smaller capacity top loader than the prior art top loader shown in FIG. 5. Top loader 520 includes a substantially flat, or planar lower surface 524.

Figure 18:
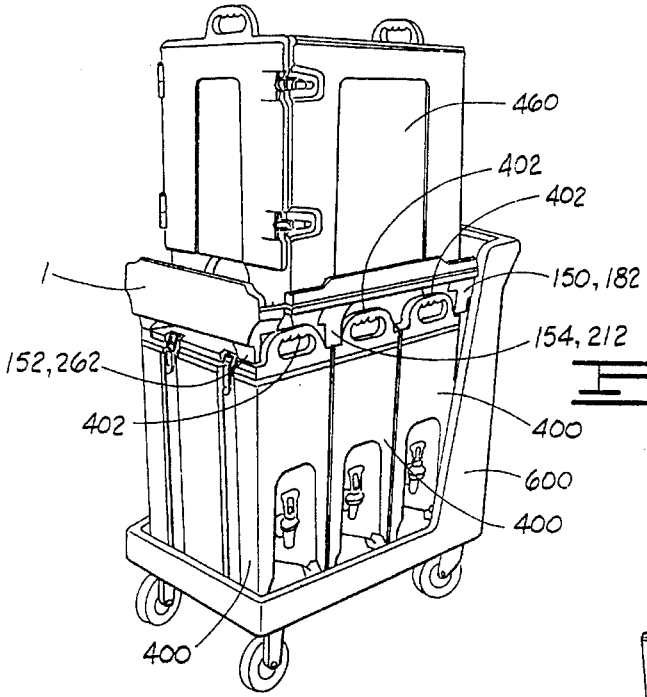
FIG. 18 shows an end loader stacked on top of pallet 1 and three beverage dispensers beneath.

The pallet 1 of the present invention can be utilized to stack various combinations of prior art catering equipment. For example, a plurality of beverage dispensers 400, or any dispenser having handles similarly spaced can be received below the pallet. One dispenser 400 can be positioned so that the pair of upwardly extending handles 402 are received in the first and second forward openings 281 and 283 respectively. The openings substantially prevent relative lateral and longitudinal relative movement between the dispensers and the pallet. The handles 402 of two dispensers placed side by side can likewise be received in the first and second rear openings 226 and 228. Such a configuration is shown in FIG. 18.

Figure 19:
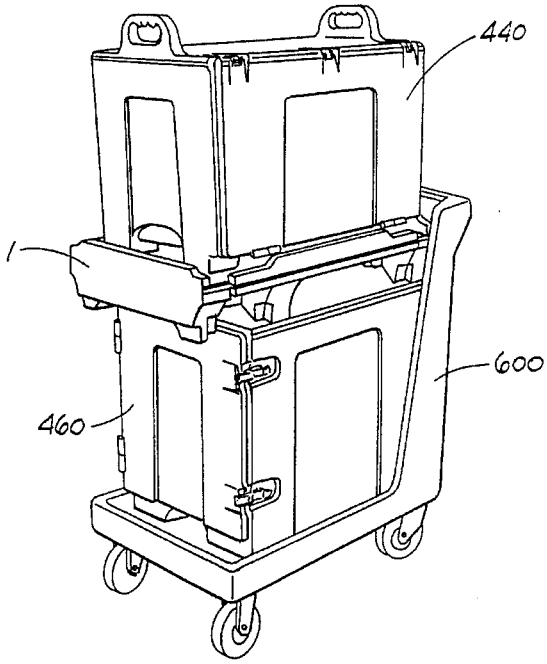
FIG. 19 shows a side loader stacked on top of a pallet and an end loader beneath.
Figure 20:
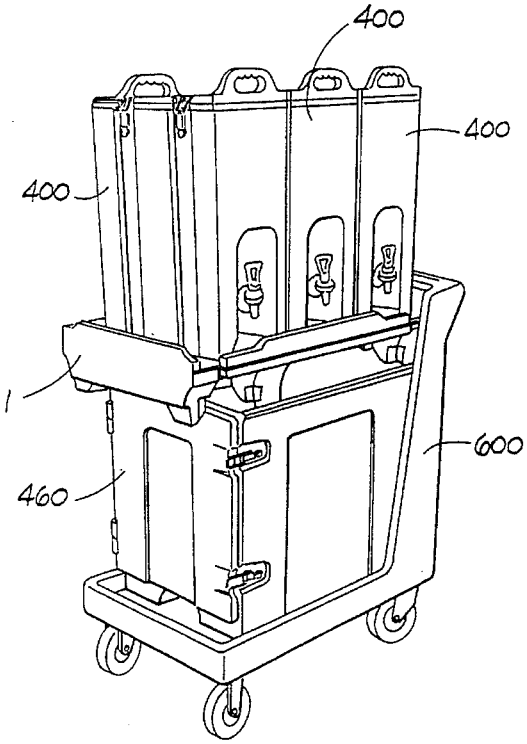
FIG. 20 shows three beverage dispensers stacked on a pallet and an end loader beneath.

Prior art beverage dispensers, side loaders, end loaders and top loaders like or similar to those shown in FIGS. 2–5 respectively, or any type of catering equipment having a similar handle configuration as those shown, may also be placed beneath the pallet of the present invention. The catering equipment is to be positioned so that one of the upwardly extending handles is received in transverse slot 196. The transverse slot will prevent relative movement between the catering equipment and the pallet. The remaining upwardly extending handle of the catering equipment will be received in cavity 294. FIGS. 19 and 20 show end loaders located beneath and interlocked with pallet 1. The combinations shown in FIGS. 18, 19 and 20 are shown stacked on a transportable dolly 600. The dolly 600 has an upper surface configuration that is substantially the same as that of the upper surface of the pallet. Clearly, the combinations shown are merely examples, and are not in any way limiting.

In all cases, the upwardly extending handles are not load bearing handles. Transverse slot 196 and cavity 294 are of sufficient depth to prevent the handles from engaging lower surface 10 of the pallet. Likewise, the grooves which define forward and rear openings 156 and 158 are of sufficient length to allow the lower surface of the legs of pallet 1 to engage the upper surface of the catering equipment before the handles engage the upper termination point of the grooves. Instead, the upper surface of the catering equipment described herein will engage the coplanar lower surfaces of the legs of pallet 1.

Numerous types of catering equipment can be received on the upper surface of the pallet. End loaders, side loaders and top loaders and any similar type of catering equipment having four legs extending from a lower end thereof can be received on the top surface of the pallet with the legs located in the four recesses 96, 98 100 and 102. FIGS. 18 and 19 show an end loader and a side loader respectively stacked on top of pallet 1. In addition, three beverage dispensers 400, as depicted in FIG. 20, can be received side by side on the top of the pallet. The lower ends of the beverage dispensers will engage the intermediate surface 94 of the upper surface. When such a combination is desired the center dispensers should be placed such that legs 412 and 414 of the center dispenser straddle center step portion 104. The dispenser placed to the rear of the middle dispenser will be placed so that the rear leg of the dispenser nests between rear shoulder 124 and rear end wall 40. The remaining leg of the rear dispenser will engage intermediate surface 94 between rear step 108 and the rear leg of the middle dispenser. The forward dispenser will be placed so that the forward leg of the rear dispenser engages intermediate surface 94 between forward shoulder 122 and forward end wall 32. The rear leg of the forward dispenser will engage intermediate surface 94 between the forward step 106 and the forward leg of the middle dispense. Thus, stepped portion 92 and shoulders 122 and 124 prevent slippage.

A prior art beverage dispenser like that or similar to the one shown in FIG. 2, can be placed on top of the pallet 1 so that the legs 430 engage intermediate surface 94 along the sides of the upper surface. Stepped portion 92, along with side walls 62 and 64 will prevent slippage of beverage dispenser 420. Stepped portion 92 will also engage the lower surface of any type of catering equipment which has a flat or substantially flat lower surface, such as the catering equipment shown in FIG. 6. The forward wall, end wall and side walls will retain all of the catering equipment on the upper surface of the pallet floor shown herein and similar types of catering equipment.

The examples provided herein of catering equipment, and the combinations of such equipment that can be stacked utilizing the pallet 1 are merely illustrative and are not in any way limiting. Any type of catering equipment having configurations similar to those addressed here may be used in combination with the pallet to stack the catering equipment.

The invention being best described, it will be obvious that the same may be varied in many ways. Such variations are not to be regarded as a departure from the spirit and scope of the invention, and all such modifications are intended to be included within the scope of the following claims.

What is claimed is:

1. A pallet for stacking catering equipment comprising:

a substantially rectangular pallet floor, said pallet floor having a top surface for receiving and interlocking with said catering equipment, said pallet floor having a bottom surface and having a forward end and a rear end;

a forward end wall extending upwardly from said top surface of said pallet floor at said forward end of said floor;

a rear end wall extending upwardly from said top surface of said pallet floor at said rear end of said floor;

a pair of upwardly extending transversely opposed sidewalls located along the sides of said floor;

a pair of transversely opposed downwardly extending rear legs disposed at said rear end of said floor, said rear legs having a lower surface;

receiving means disposed between said rear legs for captively receiving an upwardly extending handle of said catering equipment to substantially prevent relative movement between said catering equipment and said pallet, when said catering equipment is placed thereunder;

a pair of transversely opposed downwardly extending forward legs disposed at said forward end of said floor, said forward legs having a lower surface; and a pair of transversely opposed downwardly extending intermediate legs disposed between said forward legs and said rear legs, said intermediate legs having a lower surface.

2. The pallet of claim 1, wherein said lower surfaces of said forward legs, said rear legs and said intermediate legs are substantially coplanar so that said legs will engage an upper surface of said catering equipment when said catering equipment is placed therebelow.

3. The pallet of claim 1 further comprising a downwardly extending rear support beam located at said rear end of said floor, said rear legs extending downwardly from said rear support beam, wherein said receiving means comprises a transverse slot disposed in said rear support beam for captively receiving said upwardly extending handle of said catering equipment, thereby interlocking said pallet and said catering equipment to substantially prevent relative movement therebetween.

4. The pallet of claim 3 further comprising:

a downwardly extending forward support beam located at said forward end of said pallet, said forward legs extending downwardly from said forward support beam;

an intermediate support beam interconnecting said pair of intermediate legs, said intermediate support beam extending downwardly from said bottom surface of said pallet floor;

a first rib connected at a first end to said forward beam and at a second end to said intermediate support beam; and a second rib connected at a first end to said forward support beam and at a second end to said intermediate support beam wherein said first and second ribs and said forward and intermediate support beams define a cavity for receiving an upwardly extending handle of said catering equipment.

5. The pallet of claim 1 wherein:

said pair of forward legs comprises a first and second forward leg, said first and second forward legs each having a rear surface defined thereon; and wherein said intermediate pair of legs comprises a first and second intermediate leg, said first and second intermediate legs each having a forward surface and a rear surface defined thereon so that said rear surface of said first forward leg and said forward surface of said first intermediate leg define a first forward opening for receiving an upwardly extending handle of said catering equipment and said rear surface of said second forward leg and said forward surface of said second intermediate leg define a second forward opening for receiving an upwardly extending handle of said catering equipment.

6. The pallet of claim 5 wherein said rear pair of legs comprises a first rear leg and a second rear leg, said first and second rear legs each having a forward surface defined thereon, so that said forward surface of said first rear leg and said rear surface of said first intermediate leg define a first rear opening for receiving the upwardly extending handles of said catering equipment and said forward surface of said second rear leg and said rear surface of said second intermediate leg define a second rear opening for receiving the upwardly extending handles of said catering equipment.

7. The pallet of claim 6 further comprising:

a first forward groove defined on said rear surface of said first forward leg;

a first intermediate groove defined on said forward surface of said first intermediate leg, wherein said first forward groove and said first intermediate groove define said first forward opening;

a second forward groove defined on said rear surface of said second forward leg; and a second intermediate groove defined on said forward surface of said second intermediate leg, wherein said second forward groove and said second intermediate groove define said second forward opening.

8. The pallet of claim 7 further comprising:

a first rear groove defined on said forward facing surface of said first rear leg, wherein said first rear groove and said rear surface of said first intermediate leg define said first rear opening; and a second rear groove defined on said forward surface of said second rear leg, wherein said second rear groove and said rear surface of said second intermediate leg define said second rear opening.

9. The pallet of claim 1 further comprising a pair of transversely opposed slots disposed through said pallet floor.

10. The pallet of claim 1 wherein said top surface comprises:

a recessed portion;

a stepped portion; and an intermediate portion defined between said recessed portion and said stepped portion.

11. The pallet of claim 10 wherein said recessed portion comprises four recesses, one each of said recesses being positioned near a corner of said pallet floor, so that the legs of a piece of said catering equipment may be received therein.

12. The pallet of claim 11 wherein said top surface of said pallet floor is substantially symmetric about a longitudinal and a transverse axis.

13. The pallet of claim 1 further comprising:

a forward stabilizing shoulder extending upward from said top surface of said pallet floor, and a rear stabilizing shoulder extending upward from said top surface of said pallet floor.

14. The pallet of claim 1 wherein said pallets are stackable pallets.

15. An apparatus for stacking food service and catering equipment comprising:

a base having a top surface and a bottom surface;

a pair of rear legs extending downwardly from a rear end of said article;

a pair of forward legs extending downwardly from a forward end of said article; and a pair of intermediate legs interposed between said forward and said rear legs, said legs extending downwardly from said bottom surface of said base, wherein said pair of intermediate legs and said pair of forward legs define a pair of forward openings for receiving the handles of a piece of said catering equipment and wherein said rear legs and said intermediate legs define a pair of rear openings for receiving the handles of additional pieces of said catering equipment, so that said forward and rear openings substantially prevent relative movement between said catering equipment and said apparatus when said handles are received therein.

16. The apparatus of claim 15 further comprising:

a downwardly extending rear support beam positioned at said rear end of said article, said rear legs extending downwardly therefrom; and a transverse slot defined in said rear support beam between said rear legs for receiving the handle of a piece of catering equipment, so that said slot substantially prevents relative movement between said apparatus and said catering equipment when said handle is received therein.

17. The apparatus of claim 16 further comprising:

a downwardly extending forward support beam positioned at said forward end of said article, said forward legs extending downwardly therefrom;

a downwardly extending intermediate support beam connecting said intermediate legs;

a first rib attached at a first end to said forward support beam and at a second end to said intermediate support beam; and a second rib attached at a first end to said forward support beam and at a second end to said intermediate support beam, wherein said first rib, second rib, forward support beam and intermediate support beam define a cavity for receiving a handle of said catering equipment to substantially prevent relative movement between said catering equipment and said apparatus when said handle is received therein.

18. The apparatus of claim 15 further comprising:

a forward end wall extending upwardly from said top surface of said base at said forward end;

a rear end wall extending upwardly from said top surface of said base at said rear end; and a pair of transversely opposed side walls extending upwardly from said top surface of said base.

19. The apparatus of claim 18 wherein said rear legs and said forward legs of a first said apparatus may be received between said forward end wall and said rear end wall of a second said apparatus, so that said apparatus are stackable.

20. The apparatus of claim 18 further comprising a recessed portion defined on said top surface of said base, wherein said recessed portion comprises four recesses, one each of said recesses being positioned at a corner of said apparatus for receiving the legs of a piece of said catering equipment.

21. The apparatus of claim 18 further comprising a stepped portion defined on said top surface of said base for engaging a lower surface of said catering equipment.

22. The apparatus of claim 20 wherein said stepped portion comprises:

a center step defined on said top surface;

a rear step defined on said top surface between said rear end wall and said center step; and a forward step defined on said top surface between said forward end wall and said center step.

23. The apparatus of claim 15 further comprising:

a pair of forward facing rear notches disposed in said rear legs, wherein said pair of rear openings are defined by said rear notches and a rear surface defined on said pair of said intermediate legs;

a pair of forward facing intermediate notches defined in said pair of intermediate legs; and a pair of rear facing forward notches defined in said pair of forward legs wherein said forward openings are defined by said forward and intermediate notches, and wherein the handles of said catering equipment may be received in said notches so that said notches prevent relative movement between said catering equipment and said apparatus when said handles are received therein.

* * * * *